United States Patent [19]

Mitchell

[11] Patent Number: 4,974,575

[45] Date of Patent: Dec. 4, 1990

[54] BOW BLIND

[76] Inventor: Frank E. Mitchell, 10961 Marne, Detroit, Mich. 48224

[21] Appl. No.: 478,521

[22] Filed: Feb. 12, 1990

[51] Int. Cl.[5] ..... F41B 5/20

[52] U.S. Cl. ..... 124/88; 124/23.1; 124/89; 43/1; 135/901

[58] Field of Search ..... 124/88, 89, 86, 23.1, 124/25.6; 135/901, 109, 106; 40/610; 43/1; 403/170, 174, 217

[56] References Cited

U.S. PATENT DOCUMENTS

| | | | |
|---|---|---|---|
| 2,953,145 | 9/1960 | Moss et al. | 135/901 X |
| 3,179,102 | 4/1965 | Peckham | 124/88 X |
| 3,628,520 | 12/1971 | Izuta | 124/23.1 X |
| 4,817,579 | 4/1989 | Mathias | 124/86 |
| 4,876,817 | 10/1989 | Hill | 124/88 X |

OTHER PUBLICATIONS

"Original Trebark Catalog", (Fall/Winter) by Jim Crumley, p. 16, 1989.

*Primary Examiner*—Peter M. Cuomo
*Attorney, Agent, or Firm*—Charles W. Chandler

[57] ABSTRACT

A blind to be attached to a compound bow by a support rod threaded into the standard, threaded hole provided in the front of the bow to receive a stabilizer rod. The blind includes a central block supported at the end of the rod and having a threaded opening in its front surface to receive a standard stabilizer rod. Ribs radiate outwardly from the block to support the perimeter portions of a camouflage cloth spaced a short distance ahead of the bow.

6 Claims, 2 Drawing Sheets

BOW BLIND

BACKGROUND OF THE INVENTION

This invention relates to bow blinds for use on compound bows and particularly to bow blinds suitable for mounting in the threaded hole provided in the riser of compound bows to receive stabilizer rods.

U.S Pat. No. 4,817,579 issued to Ralph R. Mathias shows a camouflage shield that can be mounted on a compound bow to hide the person using the bow from the sight of an animal being hunted. However, the shield is mounted on a special support that requires special holes to be drilled in the riser of the bow. In addition, the shield has a perimeter frame and a central frame member attached to the support structure, all of which add to the weight of the shield and make it difficult to carry through the woods.

Another camouflage shield is illustrated in the "Original Trebark Catalogue" that has a lighter weight structure and uses radial ribs to stretch a rectangular piece of camouflage cloth attached only to the tips of the ribs. The ribs are supported by a central support member attached to the outer end of a stabilizer rod by means of a screw threaded into the end of the rod. Since stabilizer rods are not normally drilled and tapped to receive a screw, this has to be done for each stabilizer on which the shield would be mounted, and such stabilizers are anywhere from a few inches to a few feet long. That means that the shield could be several feet from the person using the bow, which would considerably reduce its ability to shield the person from view.

OBJECTS AND SUMMARY OF THE INVENTION

It is one of the objects of the present invention to provide an improved bow blind that can be easily and quickly mounted on a compound bow and separated therefrom and can be easily carried with other equipment used by a bow hunter.

Further objects will be apparent from the following description together with the accompanying drawings.

In accordance with the present invention, a bow blind in the form of a camouflage sheet is supported by radial ribs attached to a main member connected by means of a rod to a compound bow. The rod is threaded to screw into the stabilizer hole that is a standard feature of compound bows, and the main member has a threaded hole in the surface that faces away from the bow to receive the stabilizer in it. This makes it unnecessary to drill and tap the outer end of the stabilizer and allows a standard stabilizer to be used. No matter what the length of the stabilizer, the blind is always spaced only a short distance ahead of the bow, which distance is determined by the length of the rod and is typically only a few inches.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
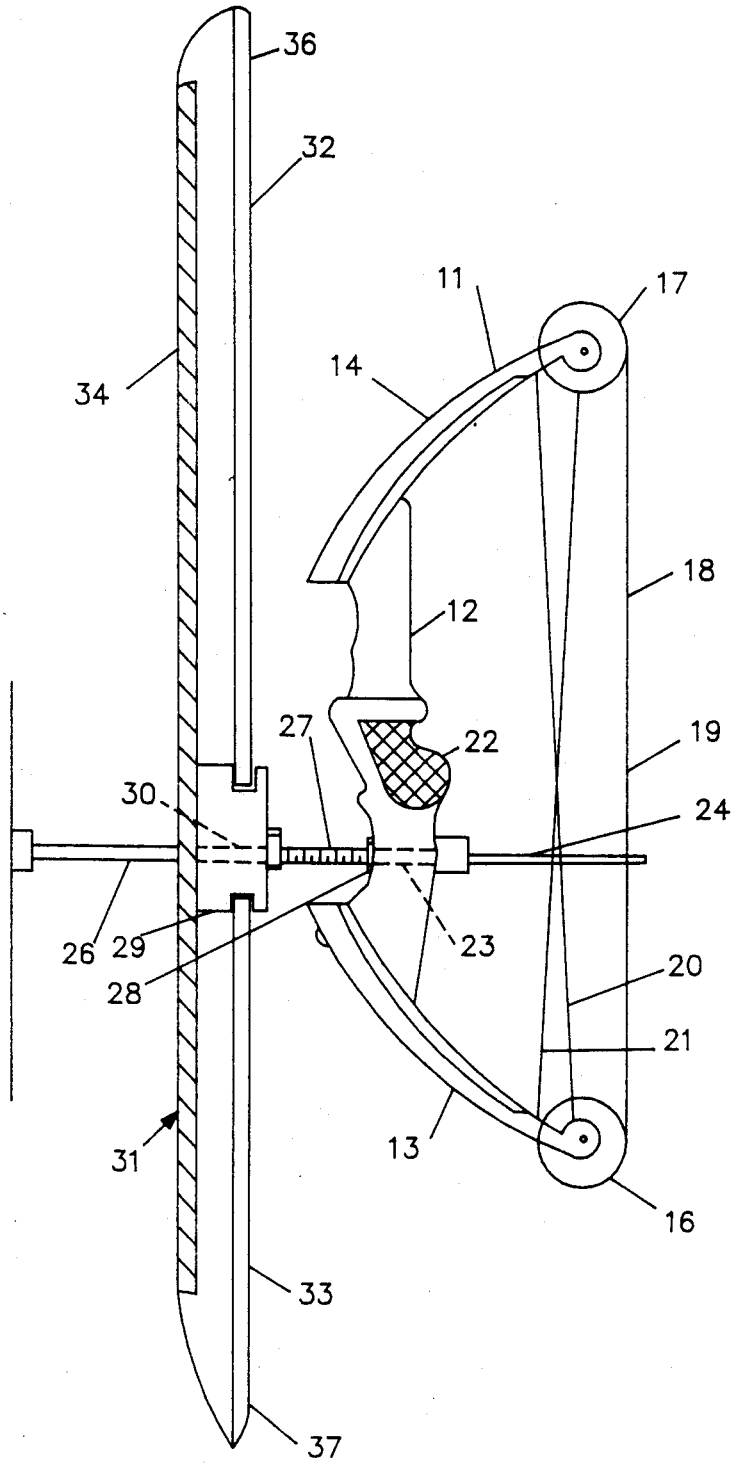
FIG. 1 is a side view of a compound bow on which is mounted the blind bow of this invention.

FIG. 1 shows a compound bow 11 having a central riser 12 and limbs 13 and 14 extending from it. At the end of the limb 13 is a transition wheel 16 and at the end of the limb 14 is a similar transition wheel 17. These wheels are pulleys around which is wound the string 18 consisting of a central part 19 and two end parts 20 and 21.

The riser has a hand grip 22 below which there is a hole 23 threaded to receive a separator 24 that extends to the rear of the riser and keeps the central part of the string 18 from touching the end parts 20 and 21. The threaded hole 23 extends all the way through the riser, and it is normally expected that the threaded end of a stabilizer rod 26 will be screwed into it. However, in accordance with this invention, a support rod 27 that is threaded in a like manner, at least at one end, is screwed into the threaded hole 23. In this embodiment, the rod 27 is threaded from end to end, and in order to hold it rigidly in place on the riser, a lock nut 28 is provided.

The other end of the threaded rod 27 is threaded into a central hole 30 in a central block 29. In this embodiment, the threaded hole extends all the way through the central block, and the stabilizer 26 is threaded into the front end of it to extend forward of the bow and of the entire blind 31. The rod 27 can be rigidly attached to the block 29 other than by being screwed into it. For, example, the block and rod can be made in one piece. The other parts of the blind are several rods, or ribs, of which only two ribs 32 and 33 are visible in this figure. One end of each of these ribs is inserted in a tight-fitting socket in the side of the block 29 so that the ribs 32 and 33 stick out radially in directions determined by the orientation of their respective sockets. Typically, these ribs are about the same dimensions as an arrow and are preferably made of hollow plastic tubing so as to remain resilient, to some degree, even in cold weather. The rib diameter can range from about $\frac{1}{4}''$ O.D. to about $\frac{1}{2}''$ O.D., and are preferably about $\frac{3}{8}''$ O.D. The wall thickness is preferably about 1/16", making the I.D. $\frac{1}{4}''$ in the case of a $\frac{3}{8}''$ rib. The plastic ribs are easy to carry and provides sufficient strength to support a camouflage sheet 34, but it is possible to use other ribs instead of the hollow plastic ones.

The sheet 34 has corner pockets to receive the ends of the rods. In this view only two of the pockets 36 and 37 are visible.

Figure 2:
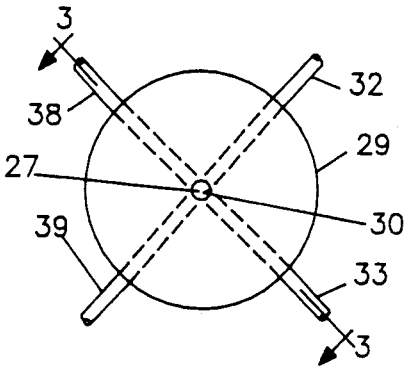
FIG. 2 is a front view of the main member in the blind in FIG. 1.

FIG. 2 shows the block 29 as it would appear from the front in the absence of the sheet 34. Only a small part of each of the fabric-supporting rib is shown. These include parts of the ribs 32 and 33, as well as ribs 38 and 39. In this embodiment the ribs 32 and 39 are diametrically opposite each other and in line with each other, and the ribs 33 and 38 are in line with each other and in the same plane as the ribs 32 and 39.

In this embodiment the block 29 is circular, although it is not essential that it have that shape. At its center is the threaded hole 30, which, in this instance, extends all the way through the block. The stabilizer 26 shown in FIG. 2 has been removed, but the end of the threaded rod 27 is visible in the threaded hole 30.

Figure 3:
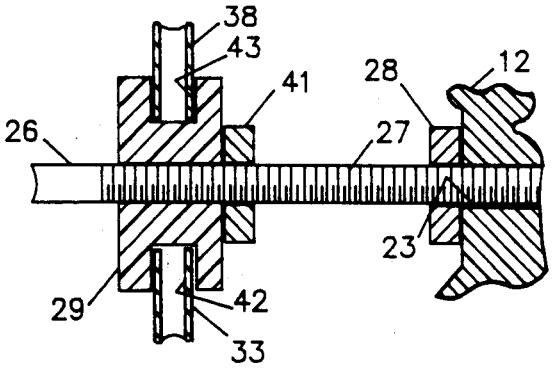
FIG. 3 is a cross-sectional view of the member in FIG. 2 along the lines 3—3.

FIG. 3 shows a cross-section of the block 29 through the centers of the ribs 33 and 38. As may be seen, one end of the rib 33 is inserted in a tight-fitting socket 42 and one end of the rib 38 is inserted in a corresponding, tight-fitting, socket 43. It is only necessary that these sockets fit tightly enough to prevent the ribs from falling out from their own weight. It is not necessary that they be so tight as to require a great deal of force to insert the ribs. The sockets and the ends of the ribs could be threaded, but this is also unnecessary.

It will be seen in FIG. 3 that the thickness of the block 29 is sufficient to allow the support rod 27 to be threaded well into it to provide a stable connection between that rod and the main member. In the case of a threaded rod 27, that is threaded from end-to-end, it is preferable to provide a lock nut 41 to press against the back surface of the block 29 in order to make certain that the support rod will not loosen up. This is similar to the lock-nut 28 threaded against the front surface of the riser 12 only a small portion of which is shown in this figure.

The block 29 is sufficiently thick to allow a part of the threaded hole 23 to receive the threaded end of a standard stabilizer 26 at sufficient depth to assure that the stabilizer is firmly held by the block 29. The block may be made of any number of materials. Nylon has been found to be quite satisfactory. If the block is a round disk, a diameter of about 3" is entirely satisfactory although the diameter can be made somewhat larger or smaller provided that it is not too heavy and that it allows sockets 42 and 43 of sufficient diameter and depth to be formed in it. A thickness of about $\frac{5}{8}$" is sufficient to provide good thread engagement between the threaded support rod 27 and the block and between the stabilizer rod 26 and the block. Sockets 42 and 43 are just large enough in diameter to receive the ribs 33 and 38 securely, and are preferably about $\frac{3}{4}$" deep to allow sufficient frictional engagement between each of the ribs 33 and 38 and the main member.

Figure 4:
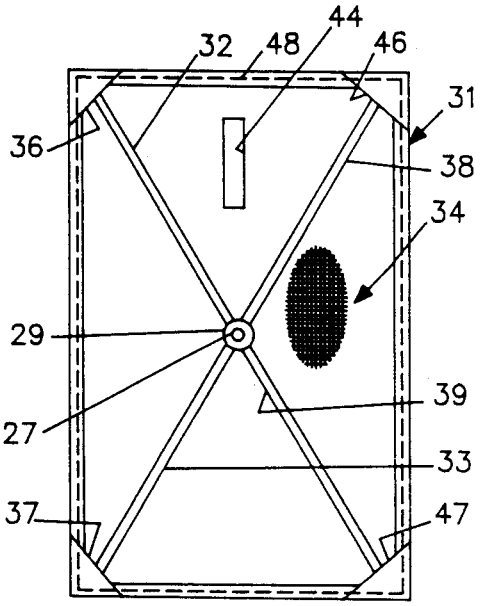
FIG. 4 is a back view of the blind in FIG. 1.

As shown in FIG. 4, which illustrates the surface of the blind facing the bow, the outline of the camouflage cloth 34 is rectangular and is taller than it is wide, as is required to shield a typical user from view. The cloth 34 has an opening 44 through which the hunter can sight and through which an arrow can pass. This opening is somewhat above the center of the blind 31 corresponding to the fact that the rod 27 fits into a threaded hole below the center of the bow 11 in FIG. 1 and below the level through which arrows pass when shot by the bow.

FIG. 4 shows the pockets 36 and 37 and corresponding pocket 46 and 47 at the other corners. In this embodiment, all four of the ribs 32, 33, 38 and 39 are the same length which is about 30" and therefore the outline of the cloth 34 is rectangular. However, it is within the scope of the invention to use different configurations other than the rectangular shape shown.

In accordance with standard sewing practice, all four edges of the cloth 34 are turned over and stitched with a line of stitches 48 to form a perimeter hem.

Figure 5:
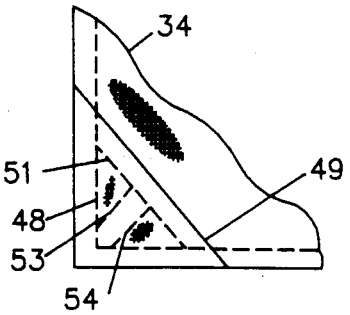
FIG. 5 is an enlarged view of a corner fragment of the blind in FIG. 4.

As shown in FIG. 5, the pocket 37, which is typical of all of the pockets, is formed by placing a triangular piece of cloth 49 over the front area of the cloth 34 and holding it in place by a suitable line of stitching, which may be the line 48 that holds the edge hem of the entire cloth panel in place. In addition, smaller receptacles are formed by means of a line of stitching 51 and another line of stitching 52 along the diagonal edge of the triangular piece of cloth 49. Two other lines of stitching 53 and 54 are spaced far enough apart to allow an end of any of the ribs to be inserted between them. The lines of stitching 53 and 54 help hold the cloth 34 more neatly in place on the rib that extends into that corner of the cloth, and the lines of stitching 51 and 52 prevent the rib from being inserted except into the open area between the stitch lines 53 and 54.

I have described an improved bow blind of lightweight construction at a range to fit closely in front of the bow in use and to be easily attached to and detached from the bow and assembled and disassembled for convenience in carrying it through the woods. Further, it permits a standard stabilizer to be screwed into the hole in the central block of the blind without having to be modified in any way.

Having described my invention, I claim:

1. Camouflage means for use on a compound bow that has a riser with a threaded hole to receive a threaded end of a stabilizer rod to hold the rod firmly so that it extends forward of the bow, the camouflage means comprising:

a central block having a front surface with a threaded hole therein to receive the threaded end of the stabilizer rod to hold the stabilizer rod firmly so that it extends forward from the central block, the block also having a rear surface and a plurality of side sockets;

a support rod rigidly attached to the block and extending from the rear surface thereof and comprising a threaded end to fit firmly into the threaded hole in the bow in place of a stabilizer rod to support the block in a fixed position forward of the bow;

a plurality of ribs to fit snugly in the side sockets, the sockets being located so that the ribs radiate out in different directions from the block; and a camouflage cloth comprising corner pockets spaced according to the locations of the outer tips of the ribs in the side sockets whereby the ribs, when inserted in the corner pockets, extend the cloth outwardly in front of the bow and generally athwart the longitudinal direction of the support rod to prevent an animal ahead of the cloth from seeing the person using the bow.

2. The camouflage means of claim 1, in which the support rod is separate from the central block and comprises a second threaded end, the threaded hole in the block extending entirely through it to receive the second end of the threaded support rod at the rear surface of the central block.

3. The camouflage means of claim 2, in which the support rod is threaded from end-to-end, said camouflage means further comprising threaded locking means on the support rod to engage the rear surface of the block and the forward surface of the bow at respective locations surrounding the support rod to hold the support rod rigidly in place in the main member and in the bow.

4. The camouflage means of claim 1, in which the ribs are resilient and made of hollow tubular plastic having an outer diameter between about $\frac{1}{4}$" and about $\frac{1}{2}$" and a length between about 20" and 40".

5. The camouflage means of claim 4, in which the ribs are about 30" long and have an outer diameter of about $\frac{3}{8}$" and an inner diameter of about $\frac{1}{4}$".

6. The camouflage means of claim 1, in which the block is a flat plate thicker than the outer diameter of the ribs, and the sockets are formed in a side surface of the block substantially perpendicular to the axis of the threaded hole.

* * * * *